US007361857B2

(12) United States Patent
Suh

(10) Patent No.: US 7,361,857 B2
(45) Date of Patent: Apr. 22, 2008

(54) EXTERNAL OPERATING HANDLE MECHANISM FOR MOLD CASED CIRCUIT BREAKER

(75) Inventor: Jeong-Woo Suh, Chungcheongbuk-Do (KR)

(73) Assignee: LS Industrial Systems Co., Ltd., Seoul (KR)

( * ) Notice: Subject to any disclaimer, the term of this patent is extended or adjusted under 35 U.S.C. 154(b) by 57 days.

(21) Appl. No.: 11/302,330

(22) Filed: Dec. 14, 2005

(65) Prior Publication Data

US 2006/0131145 A1 Jun. 22, 2006

(30) Foreign Application Priority Data

Dec. 16, 2004 (KR) ..... 10-2004-0107303

(51) Int. Cl.
*H01H 3/20* (2006.01)

(52) U.S. Cl. ..... 200/330; 200/43.01

(58) Field of Classification Search ..... 200/329–339, 200/43.01, 43.11, 43.14–16, 529, 553, 564, 200/572

See application file for complete search history.

(56) References Cited

U.S. PATENT DOCUMENTS 5,219,070 A * 6/1993 Grunert et al. ..... 200/330
5,288,958 A * 2/1994 Grunert et al. ..... 200/331
6,153,845 A * 11/2000 Bollinger et al. ..... 200/400
6,194,983 B1 * 2/2001 Bogdon et al. ..... 200/329
6,596,952 B1 * 7/2003 Degrazia et al. ..... 200/330

* cited by examiner

*Primary Examiner*—Elvin Enad
*Assistant Examiner*—M. Fishman
(74) *Attorney, Agent, or Firm*—Greenblum & Bernstein, P.L.C.

(57) ABSTRACT

An external operating handle mechanism for a mold cased circuit breaker comprising: an external operating handle; a pinion gear coupled to the external operating handle to be rotatable in response to a rotation of the external operating handle; a movable member provided with a rack gear portion coupled to the pinion gear to be linearly movable according to the rotation of the pinion gear, and provided with a handle connecting portion connected to the handle of the mold cased circuit breaker to linearly move the handle of the mold cased circuit breaker; and a guide member for guiding the movable member to linearly move, by which it is easy to control a stroke required for a displacement of the handle of the mold cased circuit breaker and the displacement of the external operating handle according to the stroke, and it is possible to accurately and efficiently transfer power upon performing a reset operation. Accordingly, unreasonable force may not be applied to resin molding components related to the reset operation including a handle among switching mechanisms, and thus damage or deformation of these components and a unsuccessful or imperfect reset operation can be prevented.

1 Claim, 5 Drawing Sheets

EXTERNAL OPERATING HANDLE MECHANISM FOR MOLD CASED CIRCUIT BREAKER

BACKGROUND OF THE INVENTION

1. Field of the Invention

The present invention relates to a Mold Cased Circuit Breaker (so called abbreviated as MCCB), and more particularly, to an external operating handle mechanism for a mold cased circuit breaker for operating an handle of the mold cased circuit breaker within a power distributing board or confirming an on/off state or a tripped state of the mold cased circuit breaker on a front panel of the power distributing board having the mold cased circuit breaker therein.

2. Background of the Prior Art

In general, a mold cased circuit breaker is a type of an electric apparatus using a relatively low voltage for protecting a circuit or a load by automatically breaking the circuit upon electrically occurring an overload or a short circuit. The mold cased circuit breaker typically has a case formed by molding a resin having electrical insulating properties, and thus is referred to as the Mold Cased Circuit Breaker (MCCB). A plurality of mold cased circuit breakers are installed within a power distributing board rather than being independently installed, which can be seen in many facilities consuming great power such as factories, buildings, and the like. Upon installing the mold cased circuit breakers within the power distributing board, the present invention provides a unit for operating a handle of the mold cased circuit breaker on a front panel or a door of the power distributing board which is in a state of being closed, and a unit for confirming an on/off state or a tripped state of the mold cased circuit breaker even from an outside of the power distributing board.

Hereinafter, an external operating handle mechanism of a prior art mold cased circuit breaker will now be explained in detail with reference to FIGS. 1 and 2. FIG. 1 is a side sectional view illustrating a state in which a prior art external operating handle mechanism is coupled to a mold cased circuit breaker, and FIG. 2 is a perspective view illustrating the external operating handle mechanism shown in FIG. 1 from its bottom portion.

An external operating handle mechanism 10 of the prior art mold cased circuit breaker may include a handle case 11, an external operating handle 12, a handle lever 13, and a handle plate 14. The external operating handle mechanism 10 is installed on the mold cased circuit breaker 8. The external operating handle 12 protrudes outwardly from a front panel 9 of a power distributing board (not shown).

The handle case 11 forms an appearance of the external operating handle mechanism 10, and accommodates the handle plate 14 and the handle lever 13. The handle case 11 is screw-coupled to an upper surface of the mold cased circuit breaker 8. In order to be coupled thereto, a side surface of the handle case 11 has four screw holes 11*a*.

The external operating handle 12 protrudes out of the panel 9 so as to allow a user to grab and turn it at the outside of the panel 9. The external operating handle 12 is rotatably installed at an upper side of the handle case 11. In order to allow the external operating handle 11 to protrude outwardly from the panel 9, the panel 9 has a through hole (not shown) for passing a shaft of the external operating handle 12 therethrough.

The handle lever 13 is assembled into the handle case 11 using a pin 16 to be rotatable with respect to the handle case 11. A generally square shaped connecting hole 13*a* into which a handle (not shown) of the mold cased circuit breaker 8 is inserted is formed at a bottom surface of the handle lever 13.

Semi-circular protrusions 13*a*' are formed at both sides of the connecting hole 13*a* so as to displace the handle of the mold cased circuit breaker 8 by a point-contact with the handle when the handle lever 13 rotates.

The handle plate 14 transfers a rotative power of the external operating handle 12 to the handle lever 13. For this, one side of the handle plate 14 is connected to the external operating handle 12 and the other side thereof is connected to the handle lever 13.

Hereinafter, an operation of the prior art external operating handle mechanism 10 having such construction as shown in FIGS. 1 and 2 will now be explained.

When the user rotates the external operating handle 12, the handle plate 14 connected to the external operating handle 12 also rotates.

In response to the rotation of the handle plate 13, the handle lever 13 rotates centered on the pin 16.

At this time, the protrusions 13*a*' of the handle lever 13 are point-contacted with the handle of the mold cased circuit breaker 8 to displace the handle.

Accordingly, the user rotates the external operating handle 12 to operate the handle of the mold cased circuit breaker 8, thereby turning on/off the mold cased circuit breaker 8 at the outside of the power distributing board.

However, in the prior art external operating handle mechanism 10 of the mold cased circuit breaker as described above, a rotational center of the external operating handle 12 is different from that of the handle lever 13. Accordingly, because of the two different rotational centers, it is difficult to control a stroke required for the operation of the handle of the mold cased circuit breaker 8 and an operational range of the external operating handle 12 according to the stroke.

Also, the two rotational centers are spaced from each other, and accordingly power may be inaccurately transferred to the handle of the mold cased circuit breaker 8 from the external operating handle 12. In particular, upon operating a reset function for which a large amount of power is required, an unreasonable force is applied to the handle lever 13 or resin components of other switching mechanisms. As a result, deformation or damage may occur on the handle lever 13 or the switching mechanisms, and thus the reset operation may not be successfully done or may be performed faultily.

BRIEF DESCRIPTION OF THE INVENTION

Therefore, an object of the present invention is to provide an external operating handle mechanism of a mold cased circuit breaker capable of ensuring an accurate stroke required for an external operation of a handle of the mold cased circuit breaker.

According to another embodiment of the present invention, there is provided an external operating handle mechanism for a mold cased circuit breaker by which power can be efficiently and accurately transferred to a handle of the mold cased circuit breaker, and thus resin-molded components of a switching mechanism including a handle of the mold cased circuit breaker can be prevented from being deformed or damaged while a reset operation is performed.

To achieve these and other advantages and in accordance with the purpose of the present invention, as embodied and broadly described herein, there is provided an external operating handle mechanism for a mold cased circuit breaker having a handle which is manually operated comprising: an external operating handle, a pinion gear coupled to the external operating handle to rotate in response to a rotation of the external operating handle; a movable member provided with a rack gear portion coupled to the pinion gear to linearly move according to the rotation of the pinion gear, and provided with a handle connecting portion connected with the handle of the mold cased circuit breaker to allow the handle of the mold cased circuit breaker to linearly move; and a guide member for guiding the movable member to linearly move.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE INVENTION

Reference will now be made in detail to the preferred embodiments of the present invention, examples of which are illustrated in the accompanying drawings.

Hereinafter, an external operating handle mechanism for a mold cased circuit breaker in accordance with an embodiment of the present invention will now be explained in detail with reference to the attached drawings.

Figure 1:
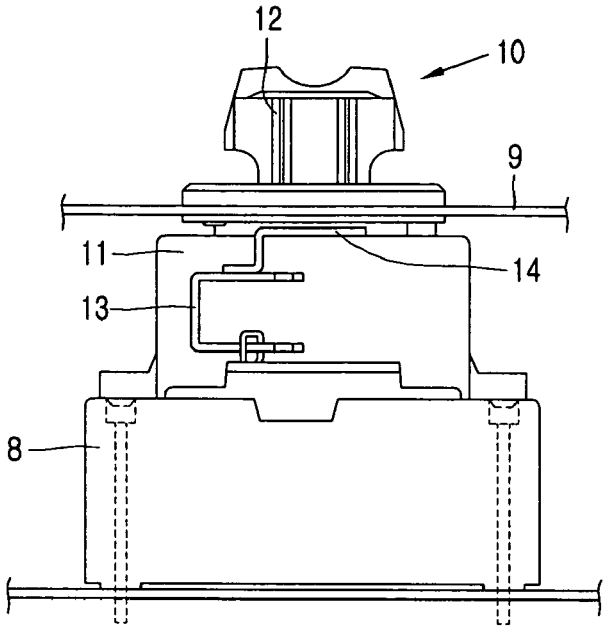
FIG. 1 CONVENTIONAL ART
FIG. 1 is a lateral sectional view illustrating a state in which a prior art external operating handle mechanism is coupled to a mold cased circuit breaker.
Figure 2:
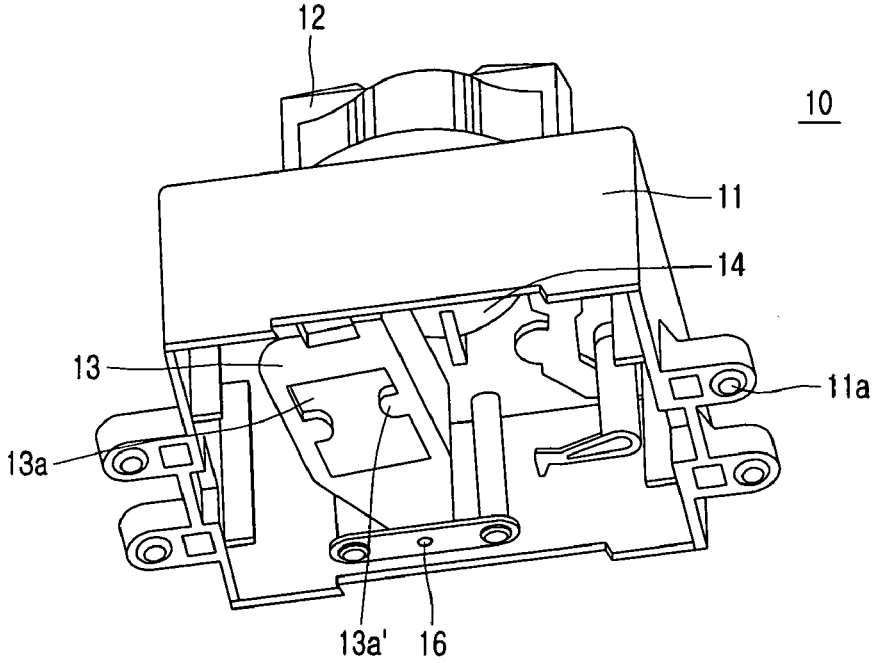
FIG. 2 CONVENTIONAL ART
FIG. 2 is a perspective view illustrating the external operating handle mechanism of FIG. 1 viewed from its bottom.
Figure 3:
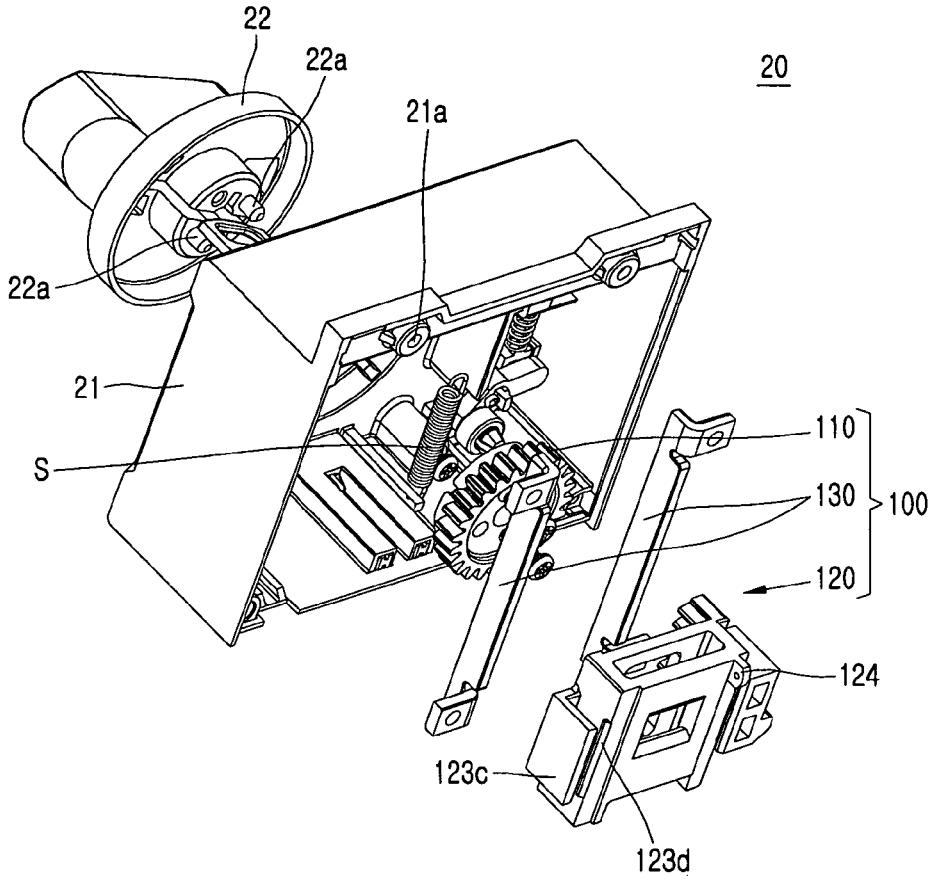
FIG. 3 is an exploded perspective view illustrating an external operating handle mechanism for a mold cased circuit breaker in accordance with an embodiment of the present invention.

Referring to FIG. 3, an external operating handle mechanism 20 for a mold cased circuit breaker in accordance with an embodiment of the present invention may include: an external operating handle 22; a pinion gear 110 coupled to the external operating handle 22 to thus rotate in response to a rotation of the external operating handle 22; a movable member 120 having a rack gear portion coupled to the pinion gear to linearly move according to the rotation of the pinion gear, and having a handle connecting portion connected to a handle 15 (refer to FIG. 5) of the mold cased circuit breaker 8 (refer to FIG. 1) to thus allow the handle 15 of the mold cased circuit breaker 8 to linearly move; and a pair of guide rail members 130 as guide members for guiding the linear movement of the movable member 120.

As illustrated in FIG. 3, unexplained reference numeral 21 denotes a case for supporting the components of the external operating handle mechanism 20 and for coupling the external operating handle mechanism 20 to the mold cased circuit breaker 8 for installation thereof. Also, reference numeral 21*a* denotes a screw hole for inserting a coupling member such as a screw therein to thus couple the case 21 to the mold cased circuit breaker 8. Preferably, four screw holes 21*a* are provided at a bottom surface of the case 21. Reference numeral 22*a* denotes a pair of power transferring shafts extending downwardly from the bottom surface of the external operating handle 22 and inserted into connecting holes 110*b* (refer to FIG. 6) formed at the pinion gear 110.

Reference numeral 100 denotes a converting unit for converting a rotative power of the external operating handle 22 including the pinion gear 110, the movable member 120 and the guide rail member 130 into a linear power.

Figure 7A:
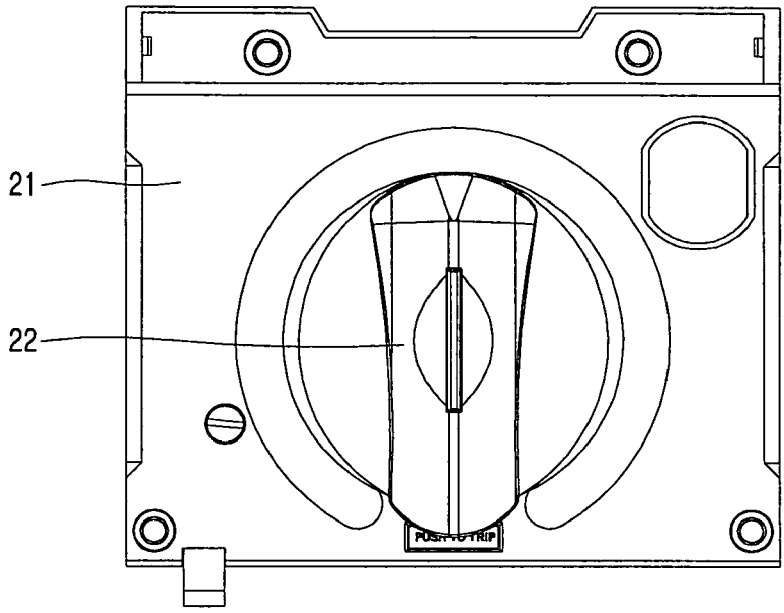
FIG. 7A is a plane view illustrating a position of an external operating handle when the external operating handle mechanism is in a turn-on state according to the present invention.
Figure 7B:
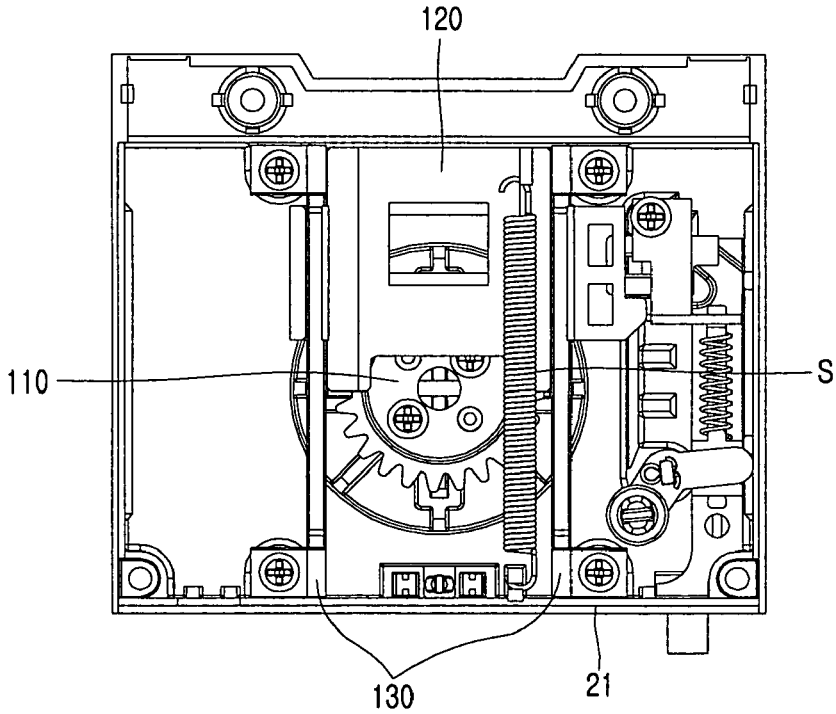
FIG. 7B is a bottom view illustrating a moving position of a movable member relative to a pinion gear and a guide rail when the external operating handle mechanism is in the turn-on state according to the present invention.

Reference numeral 124 denotes a spring support for supporting one end portion of a spring S (refer to FIGS. 7B and 8B) which biases the movable member 120 toward an off-position. The other end portion of the spring S is supported by a spring support (not designated as reference numeral) provided at the case 21 as shown in FIG. 7B.

The external operating handle mechanism 22, for example, is a type of device which protrudes outwardly from a front panel 9 (refer to FIG. 1) of a power system such as a power distributing board so as to allow a user to grab and rotate a handle of the mold cased circuit breaker to an on-position or an off-position. The external operating handle mechanism 22 is rotatably installed at an upper surface of the case 21.

Figure 4:
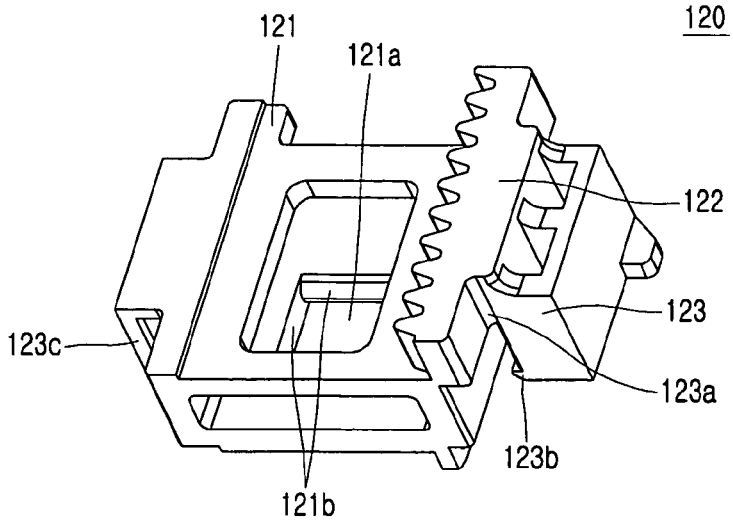
FIG. 4 is a perspective view illustrating a detailed construction of a movable member according to the present invention.

On the other hand, FIG. 4 is a perspective view illustrating a detailed construction of the movable member 120 according to the present invention, which will be explained in more detail.

As illustrated in FIG. 4, the movable member 120 may include a body 121, and guide shoes 123*a*, 123*b*, 123*c* and 123*d* protruding outwardly from both side surfaces of the body 121, respectively, and corresponding to the guide rail members 130. Referring to FIG. 4, the guide shoes 123*a* and 123*b* at a right side of the body 121 are provided between an inner wall surface of a guide shoe block 123 and a right outer wall surface of the body 121, and more particularly, provided to protrude outwardly from predetermined upper and lower positions on the inner wall surface of the guide shoe block 123. A space formed between the guide shoe 123*b* and the right outer wall surface of the body 121 has a width greater than a thickness of the guide rail member 130 by a predetermined gap. Accordingly, it is possible to insert the guide rail member 130 into the space formed between the guide shoe 123*b* and the right outer wall surface of the body 121 upon assembling the movable member 120 to the guide rail member 130. Also, the right guide shoes 123*a* and 123*b* are spaced from each other with a gap greater than a height of the guide rail member 130. As illustrated in FIG. 3, the left side guide shoes of the body 121, although only the guide shoe block 123 is shown in FIG. 4, include the guide shoe 123*c* extending in an alphabet "L" shape from the left side wall surface of the body 121, and the guide shoe 123*d* protruding horizontally from the lower portion of the left side wall surface of the body 121 by a predetermined length. A spaced distance between the guide shoes 123*c* and 123*d* is greater than a thickness of the guide rail member 130 so as to allow the guide rail member 130 to be inserted therein.

The body 121 is a generally square shaped block. A handle connecting hole 121*a* which has the generally square shape corresponding to the end portion shape of the handle of the mold cased circuit breaker is formed at the center of the block body 121, and a handle contact wall portion 121*b* contacts with the handle of the mold cased circuit breaker to pressurize the handle of the mold cased circuit breaker and thus to allow the handle thereof to move.

A rack gear portion 122 is provided at one side of an upper surface of the body 121 to be meshed with the pinion gear 110 shown in FIG. 3 and thus to convert the rotative power transferred from the pinion gear 110 into a linear power.

Figure 5:
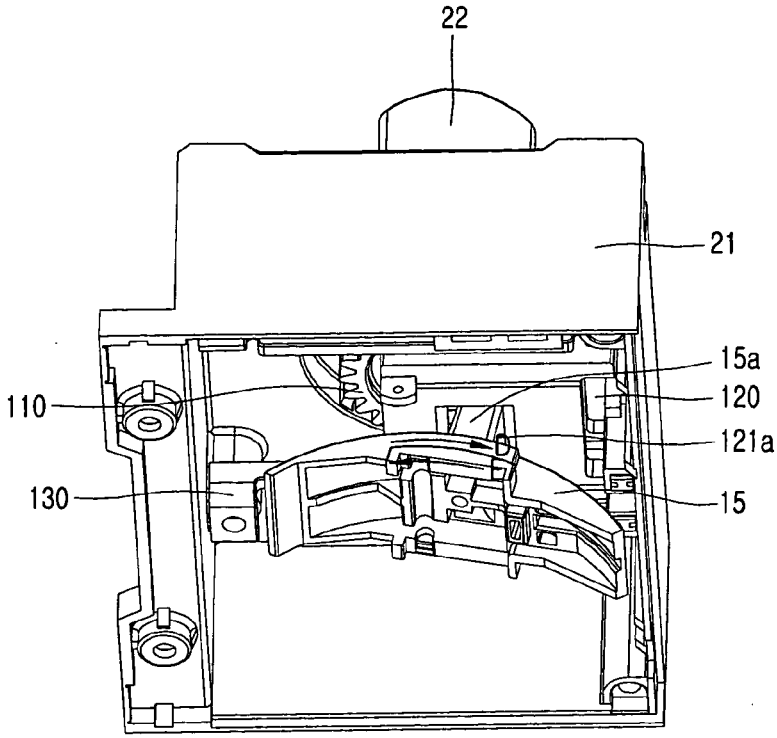
FIG. 5 is a perspective view illustrating a state in which a handle of a mold cased circuit breaker is coupled to a handle connecting hole of a movable member according to the present invention viewed from its bottom.

FIG. 5 is a perspective view showing a handle 15 of the mold cased circuit breaker is coupled to the handle connecting hole 121*a* of the movable member 120 according to the present invention viewed from the bottom. Referring to FIG. 5, a connection between the external operating handle mechanism according to the present invention and the handle of the mold cased circuit breaker and an operation thereof will now be explained.

An operating lever portion 15*a* of the handle 15 of the mold cased circuit breaker is penetratingly inserted into the handle connecting hole 121*a* formed at the center of the movable member 120, thereby connecting the external operating handle mechanism according to the present invention to the handle of the mold cased circuit breaker.

When the user grabs and rotates the external operating handle 22 in a clockwise direction or a counterclockwise direction to move it to an on-position or an off-position thereof, the pinion gear 110 rotates in the same direction as the external operating handle 22. The movable member 120 connected by the pinion gear 110 and the rack gear portion 122 linearly moves forwardly or backwardly. As a result, the operating lever portion 15*a* of the handle 15 of the mold cased circuit breaker inserted into the handle connecting hole 121*a* of the movable member 120 is pressurized by the handle contact wall portion 121*b* to thus move, and accordingly the handle 15 of the mold cased circuit breaker moves in a direction of arrow "D" or a direction of arrow "E" to thus move to its on/off-position.

Figure 6:
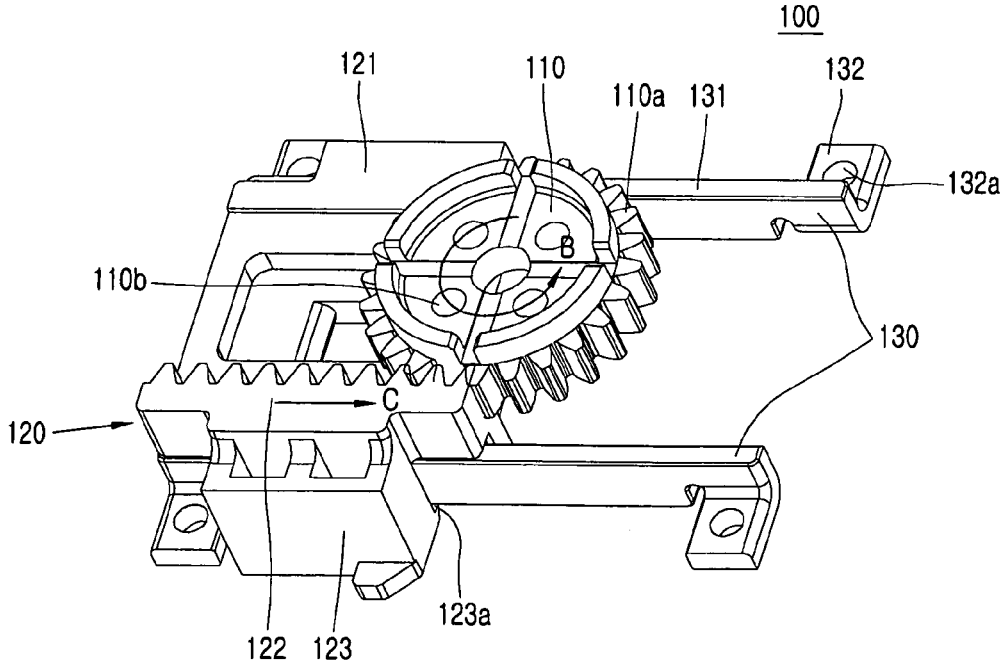
FIG. 6 is a perspective view illustrating only several main parts separately, in particular, a movable member, a pinion gear and a guide member assembled with one another in order to explain an assembly and an operation of the main components of an external operating handle mechanism according to the present invention.

FIG. 6, on the other side, is a perspective view illustrating only several main parts separately, in particular, a movable member, a pinion gear and a guide member assembled with one another in order to explain an assembly and an operation of the main components of an external operating handle mechanism according to the present invention. With reference to FIG. 6, such main parts will now be explained, beginning with an assembling procedure therebetween.

A pair of power transfer shafts 22*a* (refer to FIG. 3) of the external operating handle 22 are inserted into a pair of connecting holes 110*b* of the pinion gear 110 corresponding thereto, respectively, to thus assemble the pinion gear 110 to the external operating handle 22.

Afterwards, a rack gear portion 122 is installed to be meshed with a teeth portion 110*a* of the pinion gear 110.

Even in this state, two upper and lower guide rail members 130 illustrated in FIG. 6 are inserted respectively between the guide shoes 123*c* and 123*d* illustrated in FIG. 3 and between the guide shoe 123*b* illustrated in FIG. 4 and a right side outer wall of the body 121. At this time, the two guide rail members 130 should be installed to be maintained in parallel therewith.

Figure 8A:
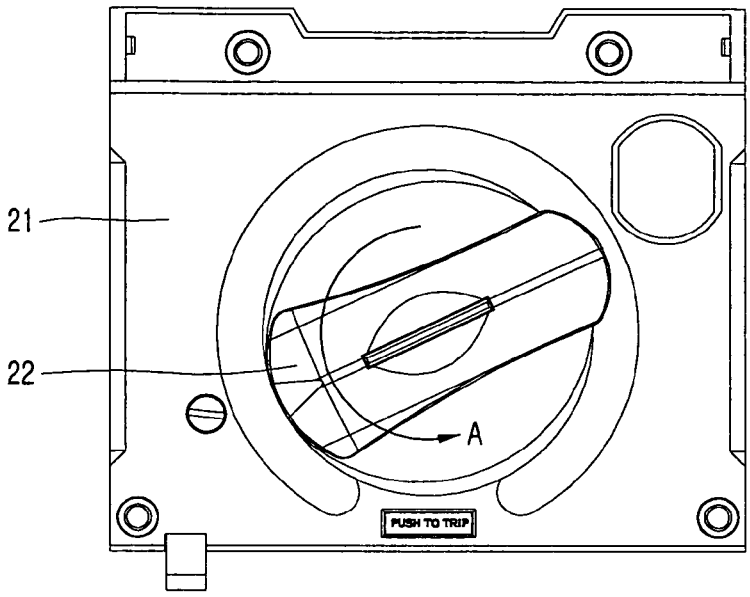
FIG. 8A is a plane view illustrating a position of the external operating handle when the external operating handle mechanism is in a turn-off state according to the present invention.
Figure 8B:
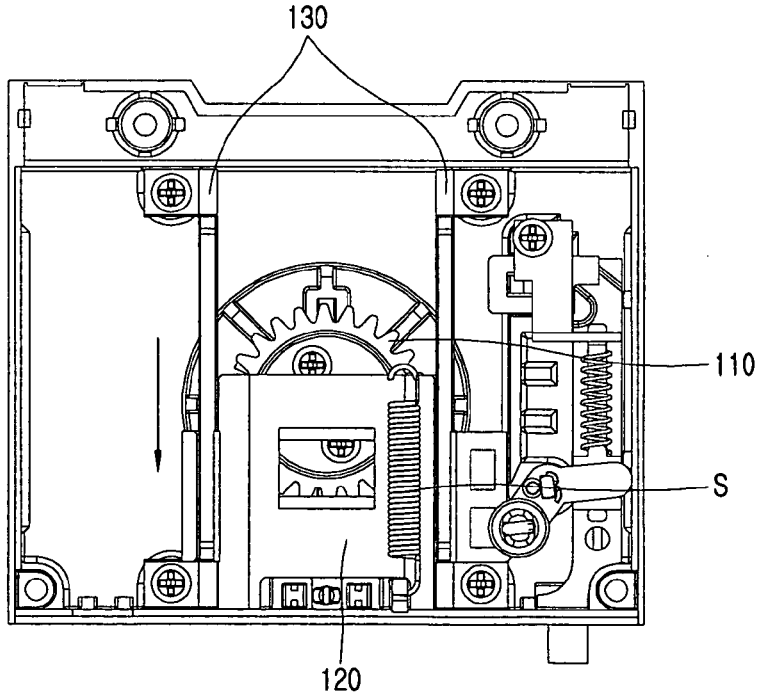
FIG. 8B is a bottom view illustrating a moving position of the movable member relative to the pinion gear and the guide rail when the external operating handle mechanism is in the turn-off state according to the present invention.

Next, screws (not shown) are inserted into screw inserting holes 132 of fixing members 132*a* provided at both end portions of each guide rail member 130. Each screw is supported by a screw support (not shown) provided at the case 21 to correspond to the screw inserting hole 132*a*. Accordingly, as illustrated in FIGS. 7B and 8B, the guide rail members 130 are fixed and the assemble is completed. A spring S for biasing the movable member 120 to the off-position may be selectively provided. At this time, one end portion of the spring S is supported by the spring support 124 of FIG. 3 and the other portion thereof is supported by a spring support (not shown) of the case 21 as illustrated in FIG. 7B.

In the assembly of the pinion gear 110, the movable member 120, and the guide rail members 130, upon rotating the external operating handle 22 in the counterclockwise direction, the pinion gear 110 rotates in the counterclockwise direction shown in FIG. 6 (i.e., a direction of arrow B). Thereafter, the movable member 120 meshed with the pinion gear 110 by the rack gear portion 122 linearly moves toward a right direction shown in FIG. 6, namely, toward the direction of arrow C. Upon rotating the external operating handle 22 in the clockwise direction, the movable member 120 linearly moves toward a left direction shown in FIG. 6. At this time, the pair of the guide rail members 130 guide the movable member 120 to linearly move accurately.

Hereinafter, an operation of the external operating handle mechanism 20 in accordance with an embodiment of the present invention will now be explained. FIG. 7A is a plane view illustrating a position of an external operating handle when the external operating handle mechanism is in a turn-on state according to the present invention, FIG. 7B is a bottom view illustrating a moving position of a movable member relative to a pinion gear and a guide rail when the external operating handle mechanism is in the turn-on state according to the present invention, FIG. 8A is a plane view illustrating a position of the external operating handle when the external operating handle mechanism is in a turn-off state according to the present invention, and FIG. 8B is a bottom view illustrating a moving position of the movable member relative to the pinion gear and the guide rail when the external operating handle mechanism is in the turn-off state according to the present invention.

An explanation will now be made with reference to FIGS. 7A to 8B. Upon desiring to move the mold cased circuit breaker from its on-position to its off-position, the user grabs the external operating handle 22 in a state in which the external operating handle 22 is positioned as illustrated in FIG. 7A, and then rotates it in the clockwise direction (e.g., by 135°). The external operating handle 22 is then positioned in the state as illustrated in FIG. 8A. At this time, the pinion gear 110 rotates in the counterclockwise direction in the drawing together with the external operating handle 22, and thus the movable member 120 positioned at an upper portion thereof moves toward a lower portion as illustrated in FIG. 8B. At this time, the pair of guide rail members 130 guide the movable member 120 to linearly move. As the movable member 120 moves downwardly, the handle 15 of the mold cased circuit breaker connected to the movable member 120 by being inserted into the handle contacting hole 121*a* of the movable member 120 moves to the off-position for breaking a circuit. At this time, an energized elastic force of the spring S accelerates a moving speed of the external operating handle 22 and the handle 15 of the mold cased circuit breaker toward the off-position thereof, so that the mold cased circuit breaker is positioned in a state shown in FIG. 8B. Accordingly, the off-operation of the mold cased circuit breaker using the external operating handle is completed.

The converting of the mold cased circuit breaker from the off-position into the on-position is operated in an opposite way to the aforementioned way. That is, the user grabs the external operating handle 22 in a state that the external operating handle 22 is positioned as illustrated in FIG. 8A, and rotates it in the clockwise direction (e.g., by 135°). The external handle 22 is then positioned as illustrated in FIG. 7A. At this time, the pinion gear 110 rotates in the clockwise direction in the drawing together with the external operating handle 22, and thus the movable member 120 positioned at the lower portion thereof moves to the upper position as illustrated in FIG. 7B. At this time, the pair of guide rail members 130 guide the movable member 120 to linearly move. As the movable member 120 moves upwardly, the handle 15 of the mold cased circuit breaker connected to the movable member 120 by being inserted into the handle connecting hole 121*a* of the movable member 120 moves toward the on-position for connecting a circuit. At this time, the spring S is in a state of being extended as illustrated in FIG. 7B. Here, because the elastic force of the spring S is smaller than a force for moving the movable member 120 coupled to the pinion gear 110, the spring S can continuously be energized with the elastic force.

Therefore, the on-operation of the mold cased circuit breaker using the external operating handle is completely performed.

As aforementioned, the external operating handle mechanism for the mold cased circuit breaker in accordance with the embodiment of the present invention may have the following effects.

First, because a converting unit has only one rotational center to convert the rotative power of the external operating handle into the linear moving force to transfer the linear moving force to the handle of the mold cased circuit breaker, the stroke required for an operation of the handle of the mold cased circuit breaker and the operational range of the external operating handle according to the stroke can effectively be controlled. Also, the one rotational center allows an efficient transfer of power from the external operating handle to the handle of the mold cased circuit breaker without a great power loss. Therefore, upon performing a reset operation requiring for a great power, deformation may occur in the handle lever or other moldings which causes a reset defect.

Second, because power is transferred from the operating handle to the handle of the mold cased circuit breaker via the pinion gear and the rack gear portion, transferring of the power can be improved as compared with the prior art operating handle. Also using of the gear makes it effective to reduce variation and error of the operational position and the stroke.

Third, an operating lever portion of the handle of the mold cased circuit breaker is surface-contacted with the handle connecting hole of the rack gear portion, and accordingly it is effective to reduce the deformation of the molding as compared to the handle operation structure by the point-contact according to the prior art.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. An external operating handle mechanism for a mold cased circuit breaker having a handle, comprising:

an external operating handle;

a pinion gear, coupled to the external operating handle, which rotates in response to a rotation of the external operating handle;

a movable member, comprising a rack gear portion coupled to the pinion gear to be linearly movable according to the rotation of the pinion gear, a handle connecting portion connected to the handle of the mold cased circuit breaker to linearly move the handle of the mold cased circuit breaker, and a plurality of guide shoes; and a pair of guide rail members provided in parallel with each other, wherein the movable member is mounted on the guide rail members via the guide shoes, wherein the movable member includes a body, the guide shoes protrude from side surfaces of the body, and the guide rail members are provided in spaces between the guide shoes and the body.

* * * * *